US006873806B2

(12) United States Patent
Kobayashi et al.

(10) Patent No.: US 6,873,806 B2
(45) Date of Patent: Mar. 29, 2005

(54) IMAGE FORMING SYSTEM WITH ADAPTABILITY BASED ON OPERATOR IDENTIFICATION

(75) Inventors: Misao Kobayashi, Kofu (JP); Shuji Ishimaru, Kofu (JP); Yusuke Asao, Kofu (JP); Sachiko Asano, Kunitachi (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/440,421

(22) Filed: May 19, 2003

(65) Prior Publication Data

US 2004/0081479 A1 Apr. 29, 2004

(30) Foreign Application Priority Data

May 20, 2002 (JP) ..... 2002-144072

(51) Int. Cl.[7] ..... G03G 15/00
(52) U.S. Cl. ..... 399/80; 399/81
(58) Field of Search ..... 399/42, 75, 77, 399/79, 80, 81, 38, 62, 366

(56) References Cited

U.S. PATENT DOCUMENTS 5,223,894 A * 6/1993 Ito ..... 399/79
5,610,688 A * 3/1997 Inamoto et al. ..... 399/366
6,038,333 A 3/2000 Wang
6,175,714 B1 * 1/2001 Crean ..... 399/366

OTHER PUBLICATIONS

Japanese Patent Application Laid–Open 60–084677 filed May 14, 1985 (English Abstract).
Japanese Patent Application Laid–Open 63–000678 filed Jan. 5, 1988 (English Abstract).
Japanese Patent Application Laid–Open 62–210589 filed Sep. 16, 1987 (English Abst.).
Japanese Patent Application Laid–Open 02–167139 filed Jun. 27, 1990 (English Abstract).
Japanese Patent Application Laid–Open 04–190470 filed Jul. 8, 1992 (English Abstract).
Japanese Patent Application Laid–Open 04–123275 filed Apr. 23, 1992 (English Abstract).
Japanese Patent Application Laid–Open 05–189546 filed Jul. 30, 1993 (English Abstract).
Japanese Patent Application Laid–Open 06–028460 filed Feb. 4, 1994 (English Abstract).
Japanese Patent Application Laid–Open 11–019070 filed Jan. 26, 1999 (Eng. Abstract).
Japanese Patent Application Laid–Open 56–151949 filed Nov. 25, 1981 (Eng. Abstract).
Japanese Patent Application Laid–Open 63–217894 filed Sep. 9, 1988 (Eng. Abstract).
Japanese Patent Application Laid–Open 01–216664 filed Aug. 30, 1989 (Eng. Abstract).

* cited by examiner

*Primary Examiner*—Hoan Tran
(74) *Attorney, Agent, or Firm*—Nixon Peabody, LLP

(57) ABSTRACT

An image forming system which can ensure high operability according to an operator is provided. A control unit 950 of a digital copying machine 1A changes an image which is displayed on a touch panel 248 according to an ID specified by an IC card, a fingerprint of an operator, or input from the touch panel 248 corresponding to each operator in accordance with operator information stored in a hard disk 961. The control unit 950 raises contrast of the image by changing the tone when an operator is the aged, makes an image to be displayed recognizable by changing the color when an operator the colorblind, indicates an image by enlarged characters when an operator is the poor sighted or a person with trembling fingers, changes languages according to an operator, and adjusts height of the touch panel 248 according to height of an operator.

22 Claims, 6 Drawing Sheets

IMAGE FORMING SYSTEM WITH ADAPTABILITY BASED ON OPERATOR IDENTIFICATION

BACKGROUND OF THE INVENTION

1. Field of the Invention

The present invention relates to an image forming system and an image forming apparatus, and in particular relates to an image forming system that has an image forming apparatus which forms an image on a sheet and at least one peripheral apparatus which is connected to the image forming apparatus, and an image forming apparatus which forms an image on a sheet.

2. Description of Related Art

In an image forming apparatus such as a copying machine, a printer or the like which is installed at a company, government or municipal office, or in an image forming system that the image forming apparatus is equipped with peripheral apparatuses, an operator conventionally had to set the number of copies, a sheet size, with or without post-processing every time he/she uses the image forming apparatus or the image forming system in spite that the same contents are set to the apparatus or the system usually.

When attention is paid to an operator, there is a visually handicapped person, or, a person who is not good at English expression due to a different using language, and accordingly the situation of every operator varies. However, such a conventional image forming apparatus or system was set for an operator of high frequency use (e.g., a normal person without physical handicap or an average American).

On the other hand, recently efficiency in office work has been strongly sought and a barrier-free state in office machines has been more longed due to the infiltration of globalization at offices, the increase in chances for the handicapped to become working members of society, and the coming of aging society. Accordingly, the image forming system and the image forming apparatus are being required to be more efficient so as to match or fit an operator.

Incidentally, relating to the present invention, techniques for fingerprint detection have been disclosed in JPB-07-21822, JPB-07-40291, JPB-07-85261, Japanese Patent (JP) 2,602,084, JP2,796,428, JP2,802,154, JP2,833,313, JP2,899,119 and JP2,959,532; techniques for voice input have been disclosed in JPB02-11901, JPB08-17507, and JP2,693,165; and a technique for identifying a person from inputted face image data by a digital camera has been disclosed in U.S. Pat. No. 6,038,333.

SUMMARY OF THE INVENTION

In view of the above circumstances, an object of the present invention is to provide an image forming system and an image forming apparatus which can ensure high operability according to an operator.

In order to achieve the above object, a first aspect of the present invention provides an image forming system that has an image forming apparatus which forms an image on a sheet and at least one peripheral apparatus which is connected to the image forming apparatus, comprising: an identifying unit for identifying an operator; a memory for memorizing setting information of the image forming system corresponding to an operator in advance; and a control unit for controlling the image forming system based upon the setting information memorized in the memory according to the operator identified by the identifying unit.

In the first aspect, setting information of the image forming system is memorized in the memory corresponding to an operator in advance. An operator is identified by the identifying unit, and the image forming system is controlled by the control unit based upon the setting information memorized in the memory according to the operator identified by the identifying unit. The identifying unit may identify the operator, for example, by setting information recorded on an external recording medium, a fingerprint of the operator, features of a face of the operator, or according to key input performed by the operator. A non-contact type recording medium which allows the identifying unit to identify the operator with non-contact may be used as the external recording medium. According to the first aspect, since the image forming system is set depending on an operator by setting the setting information according to the operator, the image forming system can ensure high operability according to an operator.

A second aspect of the present invention provides an image forming system that has an image forming apparatus which forms an image on a sheet and at least one peripheral apparatus which is connected to the image forming apparatus, comprising: a display for displaying an operating state and/or operation procedure of the image forming system; an identifying unit for identifying an operator; a memory for memorizing setting information of the image forming system corresponding to an operator in advance; and a control unit for controlling the image forming system based upon the setting information memorized in the memory according to the operator identified by the identifying unit.

In the second aspect, the setting information of the image forming system to be displayed by the display, which is memorized in the memory corresponding to an operator in advance, is identified by the identifying unit, and the display is controlled by the control unit according to the setting information. According to the second aspect, since the image forming system is set depending on an operator by setting the setting information according to the operator and the setting information is displayed on the display depending on an operator, the image forming apparatus can ensure high operability according to an operator.

In this aspect, if the control unit controls the display such that at least one of a color, a tone, and a size of an image that is to be displayed on the display is changed according to the operator identified by the identifying unit, it becomes easy for the visually handicapped, the aged, or an operator having poor sight to see the image displayed on the display. Accordingly, an image forming system that is easy to use for an operator having a visual handicap can be realized. If the control unit controls the display such that a language that is displayed on the display is changed according to the operator identified by the identifying unit, since the language is changed according to the operator, an image forming apparatus that is easy to use for an operator whose daily-using language is different is realized. If the image forming system further comprising an adjusting unit for adjusting a height and/or an angle of the display, and the control unit controls the adjusting unit such that the height and/or the angle of the display is adjusted according to the operator identified by the identifying unit, the operator becomes easy to see the display since the height and/or the angle of the display is adjusted by the adjusting unit. Accordingly, an image forming system that becomes easy to use for an operator who uses a wheelchair or who is short in height.

In the first and second aspects, if the image forming system further comprising a voice guiding unit for guiding an operating state or operation procedure of the image forming system by voice, and the control unit operates the voice guiding unit according to the operator identified by the identifying unit, since the image forming system guides the operator the operating state or operation procedure by voice, an image forming system that is easy to use for a visually handicapped person or an illiterate person can be realized. At this time, the image forming system further comprising a voice guiding unit for guiding an operating state or operation procedure of the image forming system by voice, and the control unit may operate the voice guiding unit according to the operator identified by the identifying unit.

Incidentally, in the first and second aspects, each element characterizing the image forming system maybe equipped with the image forming apparatus or the peripheral appartus.

A third aspect of the present invention provides an image forming apparatus which forms an image on a sheet, comprising: an identifying unit for identifying an operator; a memory for memorizing setting information of the image forming apparatus corresponding to an operator in advance; and a control unit for controlling the image forming apparatus based upon the setting information memorized in the memory according to the operator identified by the identifying unit.

In the third aspect, setting information of the image forming apparatus is memorized in the memory corresponding to an operator in advance. An operator is identified by the identifying unit, and the image forming apparatus is controlled by the control unit based upon the setting information memorized in the memory according to the operator who is identified by the identifying unit. According to the third aspect, since the image forming apparatus is set depending on an operator by setting the setting information according to the operator, the image forming apparatus can ensure high operability according to an operator. In this aspect, the image forming apparatus may further comprise a display for displaying an operating state or operation procedure of the image forming apparatus.

DETAILED EXPLANATION OF PREFERRED EMBODIMENTS

Embodiments of a digital copying machine to which the present invention can be applied will be explained below with reference to the drawings.

<Constitution>

Figure 1:
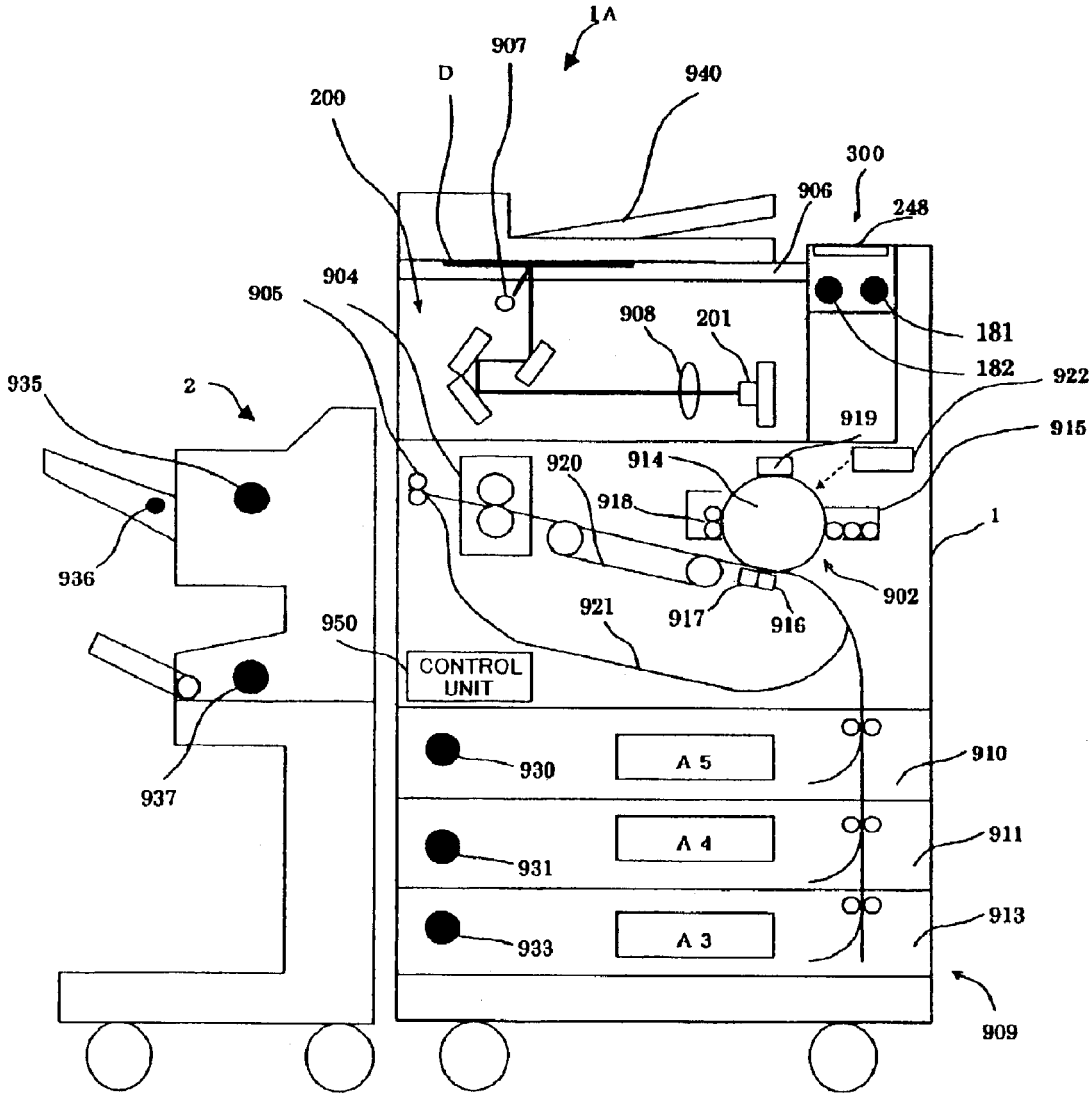
FIG. 1 is a partially broken-away front view of a digital copying machine of an embodiment to which the present invention can be applied.

As shown in FIG. 1, a digital copying machine 1A of the present embodiment is equipped with a digital copying machine main body 1 which forms an image on a sheet and a sheet post-processing apparatus 2 which is capable of mounting/connecting to the digital copying machine main body 1 and which carries out binding processing and/or folding processing to sheets discharged from the digital copying machine main body 1.

1. Digital Copying Machine Main Body

The digital copying machine main body 1 is constituted with a image forming section 902 which records a copy image of an original document D on a sheet, an image inputting section 200 which is disposed at an upper side of the image forming section 902 and which has a light source 907 and functions as a so-called scanner so as to form an image of reflected light from the original document D via an optical system 908 onto CCD 201, a sheet feeding section 909 which is disposed at a lower side of the image forming section 902 and which feeds a sheet to the image forming section 902 one by one, an information detecting section 300 for specifying (identifying) an operator as described later, and a control unit 950 which controls operation of these sections.

The sheet feeding section 909 is attachable/detachable to the digital copying machine main body 1 and which has a cassette 910 which accommodates A5 size sheets, a cassette 911 which accommodates A4 size sheets, and a cassette 913 which accommodates A3 size sheets. A5 size sheet cassette selection switch 930 for selecting the A5 size sheets manually, A4 size sheet cassette selection switch 931 for selecting the A4 size sheets manually, and A3 size sheet cassette selection switch 933 for selecting the A3 size sheets manually are respectively disposed to the cassettes 910, 911, 913. An operator can select the sheet size also from a touch panel 248. However, he/she may select the sheet size by checking with his/her eyes and pushing one of switches disposed to each cassette. Incidentally, the sheet feeding section 909 has a sheet feeding control unit 180 which controls rotation of rollers that convey a sheet to the image forming section 902 and which communicates with the control unit 950 by detecting on/off states of the selection switches 930, 931, 933 (See FIG. 5).

The image forming section 902 has a cylindrical photoconductor drum 914 which is capable of forming a latent image to an outer peripheral surface thereof. A first charging unit 919 for charging static electricity to form a latent image on the photoconductor drum 914, a laser unit 922 for outputting a modulated laser beam to the photoconductor drum 914 depending upon image data memorized in a hard disk as described later (See FIG. 5), a developing unit 915 which develops the latent image formed on the photoconductor drum 914 into a toner image, a transfer-charging unit 916 for charging electricity to transfer the toner image onto a sheet, a separation-charging unit 917 for separating a sheet from the photoconductor drum 914 by giving charge antipolar to the transfer-charging unit 916, and a cleaner 918 for cleaning the photoconductor drum 914 are respectively disposed around the photoconductor drum 914.

The laser unit 922 is constituted with a semiconductor laser which generates a laser beam, a polygon mirror which transforms the laser beam outputted from the semiconductor laser via a collimator lens into a line beam, a f-theta lens which transforms a laser beam of every scanning line from the polygon mirror into parallel light, a mirror for reflecting and guiding the parallel light from the f-theta lens to the photoconductor drum 914, and a motor for rotating the polygon mirror.

A roller to which an endless conveying belt 920 is suspended is disposed at a downstream side of the photoconductor drum 914 and at a vicinity of the separation-charging unit 917. The endless conveying belt 920 is bridged or entrained over to a roller which is disposed at a vicinity of a fixing unit 904 that has a heat roller and that heats and fixes the toner image formed on a sheet. A discharging roller pair 905 for discharging a sheet on which an image is formed from the digital copying machine main body 1 is disposed at a downstream side of the fixing unit 904. A duplex 921 for carrying out double face printing to form an image on another face of the sheet that an image has been fixed on one face.

Further, a platen glass 906 for placing the original document D is fixed at an upper portion of the digital copying machine main body 1. An auto document feeder (ADF) 940 whose one side is fixed to an end portion of the digital copying machine main body 1 and whose another side is allowed to rotate so as to cover the platen glass 906, and which feeds the original document D to the platen glass 906 automatically, is disposed at an upper side of the platen glass 906.

Figure 2:
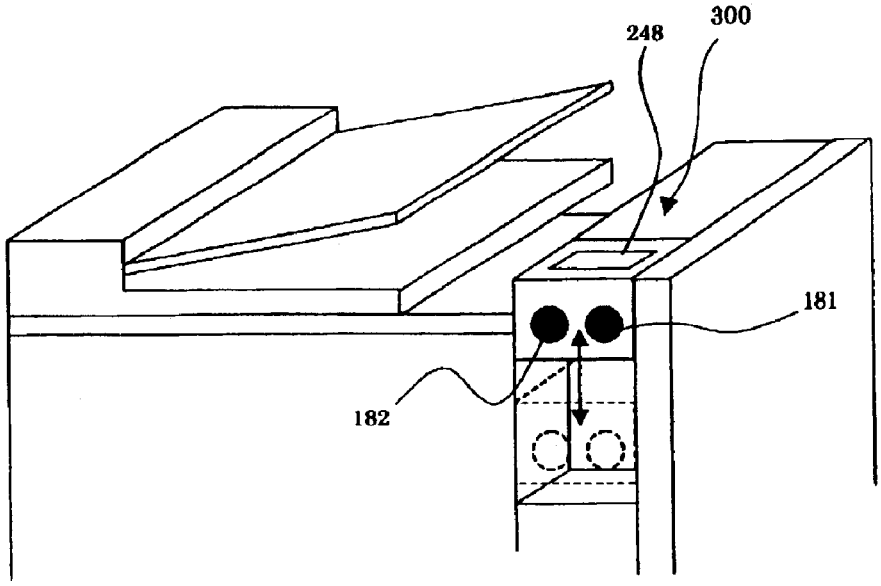
FIG. 2 is a perspective appearance view illustratively showing around a information setting unit of a digital copying machine main body.

As shown in FIG. 1 and FIG. 2, the information detecting section 300 is disposed at a side of the platen glass 906 and the ADF 940. The information detecting section 300 is constituted with the touch panel 248 which displays an operating state, operation procedure, and the like of the digital copying machine 1A by color and that an operator can instruct the operation commands to the control unit 950 according to operation, a card reader 181 for reading information recorded on an IC card in which IC chips and an antenna are embedded without contact with the IC card, an information-detecting unit 301 (See FIG. 3) which has a fingerprint sensor 182 for reading a fingerprint of an operator, and each control unit for controlling the constituting elements of the information-detecting unit 301 (See FIG. 5).

Figure 3:
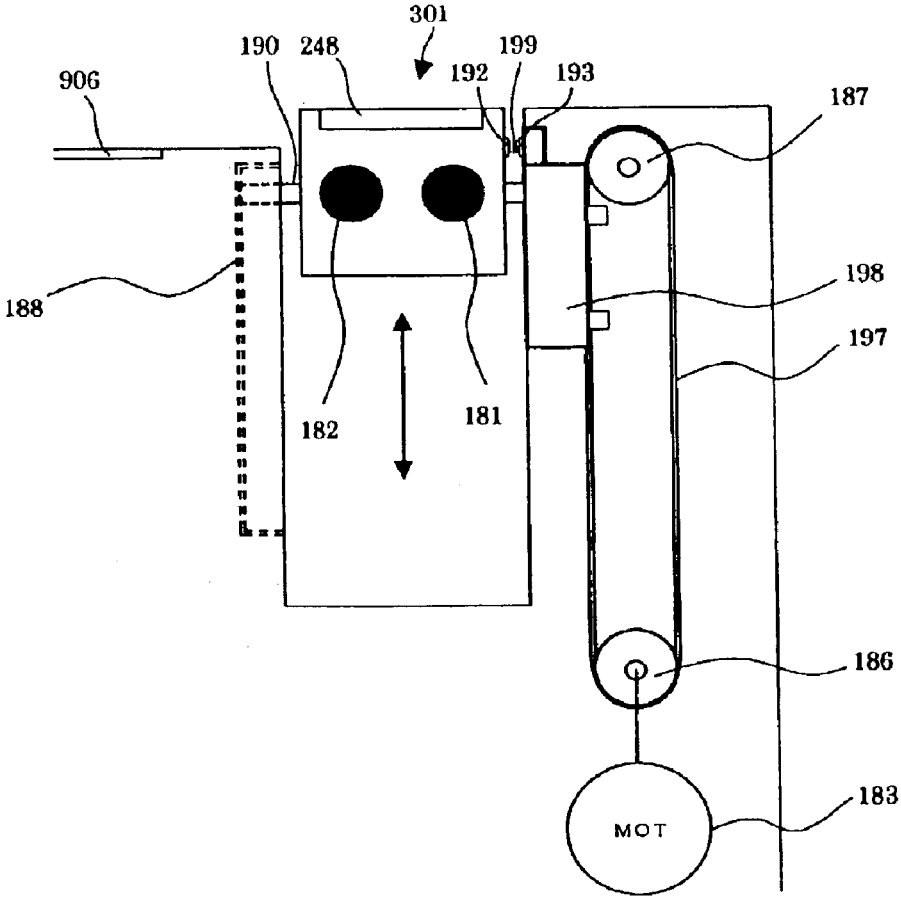
FIG. 3 is a partially broken-away front view illustratively showing around the information setting unit of the digital copying machine main body.

As shown in FIG. 3, the information-detecting unit 301 is constituted so as to be capable of ascending/descending. That is, a unit ascending/descending motor 183 consisting of a stepping motor which reversibly rotates a driving pulley 186 is disposed at a lower side portion of the information-detecting unit 301. An idle pulley 187 is disposed at an upper side of the driving pulley 186. An endless belt 197 is bridged between the driving pulley 186 and the idle pulley 187. A supporting plate 198 for supporting the information-detecting unit 301 is anchored to the endless belt 197. A rod shaped rotation shaft 190 is rotatably fixed to the supporting plate 198. The rotation shaft 190 penetrates the information-detecting unit 301, and another end thereof is inserted into a guide groove 188 which is formed in a vertical direction substantially at a side of the platen glass 906. Accordingly, the information-detecting unit 301 can move upward and downward (ascending and descending) to a generally vertical direction by driving the unit ascending/descending motor 183 in a normal or reverse direction.

Figure 4A:
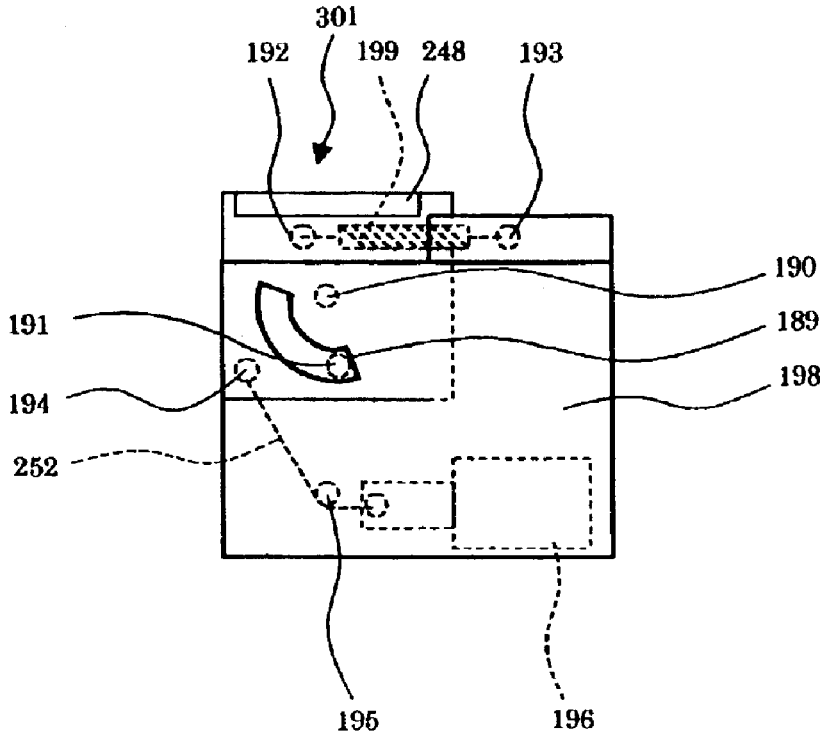
FIG. 4 is a sectional side view illustratively showing a slant mechanism of a touch panel of the digital copying machine main body, FIG. 4A showing a state of the touch panel having an ordinary angle, and FIG. 4B showing a state of the touch panel having a slant angle.

Further, the information-detecting unit 301 is constituted so as to incline a certain degree to an operator's side. As shown in FIG. 3 and FIG. 4A, a securing pin 192 is protruded from a vicinity of a surface of the information-detecting unit 301 where the card reader 181 is disposed toward the supporting plate 198. One end of a spring 199 is fixed to the securing pin 192. Another end of the spring 199 is fixed to a securing pin 193 which protrudes toward the information-detecting unit 301 from an inner side of a surface which is an upper portion of the supporting plate 198 and at which the card reader 181 is disposed. Accordingly, the spring 199 is disposed diagonally so as to traverse an axis direction of the rotation shaft 190 and which pulls the information-detecting unit 301 toward a side of the supporting plate 198 with a predetermined tensile force.

As shown in FIG. 4A, a guide pin 191 and a securing pin 194 protrudes from a lower portion of the information-detecting unit 301 toward the supporting plate 198. A tip of the guide pin 191 is inserted into a slot 189 that is an arc-shaped notch formed at the supporting plate 198. One end of a wire 252 is fixed to the securing pin 194, and another end of the wire 252 is fixed to a plunger of a solenoid 196 which is secured to the supporting plate 198. Looseness of the wire 252 is eliminated by circumscribing a securing pin 195 which protrudes from the supporting plate 198 toward the information-detecting unit 301.

Figure 4B:
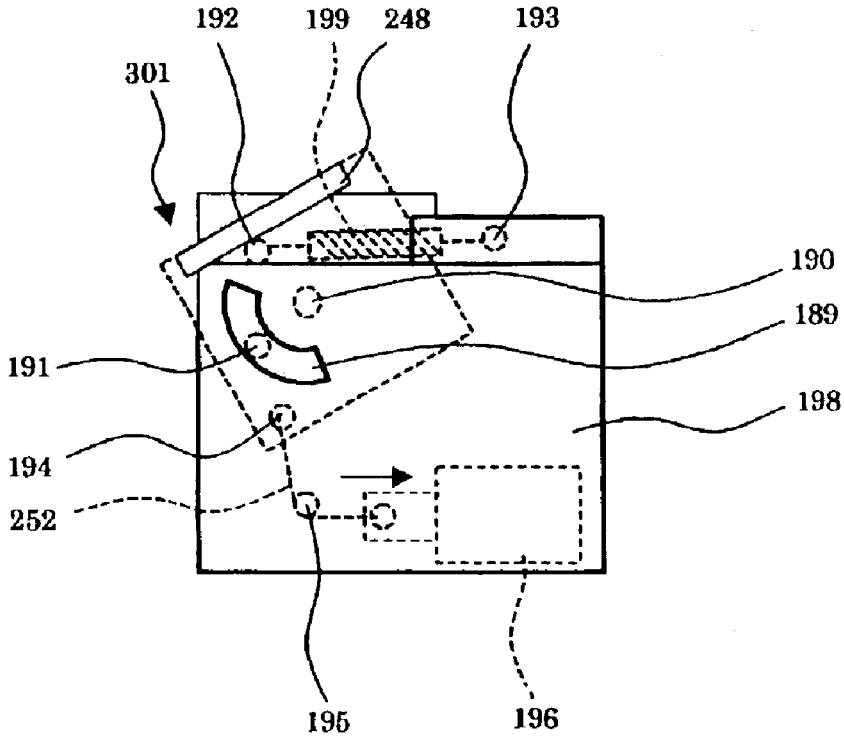

As shown in FIG. 4B, when the solenoid 196 is turned on, the plunger is pulled and the information-detecting unit 301 becomes an inclined state by pivoting around the rotation shaft 190 while resisting the tensile force of the spring 199. At this time, the guide pin 191 moves relative to the slot 189, but the inclination of the information-detecting unit 301 is regulated at a position where the guide pin 191 abuts on an upper portion of the slot 189. Therefore, the information-detecting unit 301 is constituted so as to incline a certain degree to an operator's side.

Figure 5:
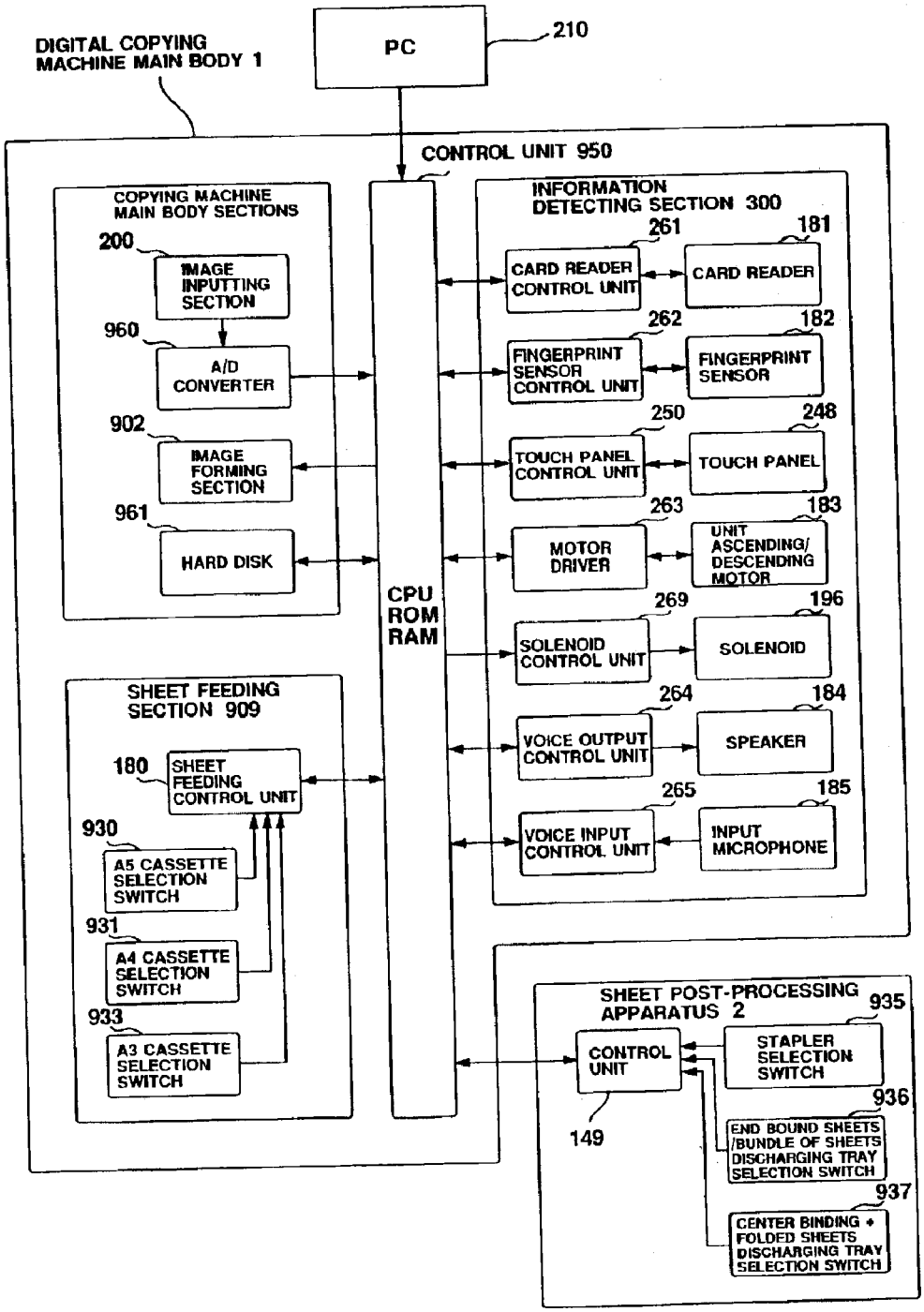
FIG. 5 is a block diagram of a control unit of the digital copying machine main body.

As shown in FIG. 5, the control unit 950 is constituted with a CPU operating as a central processing unit, a ROM in which a fundamental control program of the image copying machine 1A has been memorized, and a RAM which works as a working area for the CPU, and an internal bus for connecting these elements. An unillustrated external bus 24 is connected to the control unit 950.

The external bus is connected to a personal computer (hereinafter referred to as PC) 210, the above-described sheet feeding control unit 180, and a control unit 149 of the sheet post-processing apparatus 2 via unillustrated interfaces. Further, the external bus is connected to an A/D converter 960 which converts analog image data inputted by the image inputting section 200, the image forming section 902, and the hard disk 961 for memorizing image data transmitted from the image inputting section 200 or the PC 210 and for memorizing setting information as described later.

Furthermore, the external bus is connected to a card reader control unit 261 for controlling the card reader 181, a fingerprint sensor control unit 262 which has a sub CPU and which specifies an ID of an operator as described later by extracting fingerprint characteristics of an operator from input of the fingerprint sensor 182, a touch panel control unit 250 for controlling indication to the touch panel 248 or inputted operation commands from the touch panel 248, a motor driver 263 for reversibly rotating the unit ascending/descending motor 183, a solenoid control unit 269 for turning the solenoid 196 on or off according to a two-level signal (H level signal, L level signal), a voice output control unit 264 which has a voice IC, an amplifying circuit and the like and which guides an operator by voice an operating state and operation procedure of the digital copying machine 1A via a speaker 184, and a voice input control unit 265 which has a sub CPU, a voice recognition circuit and the like and which recognizes instructions by voice of an operator via an input microphone 185.

Moreover, the card reader control section 261 is connected to the card reader 181, the fingerprint sensor control unit 262 is connected to the fingerprint sensor 182, the touch panel control unit 250 is connected to the touch panel 248, the motor driver 263 is connected to the unit ascending/ descending motor 183, the solenoid control unit 269 is connected to the solenoid 196, the voice output control unit 264 is connected to the speaker 184, the voice input control unit 265 is connected to the input microphone 185, respectively. Incidentally, among these connections, due to the ascending/descending and inclination of the information-detecting unit 301, flexible substrates are being used for connecting portions at which signal transmission and reception are carried out.

2. Sheet Post-Processing Apparatus

Figure 6:
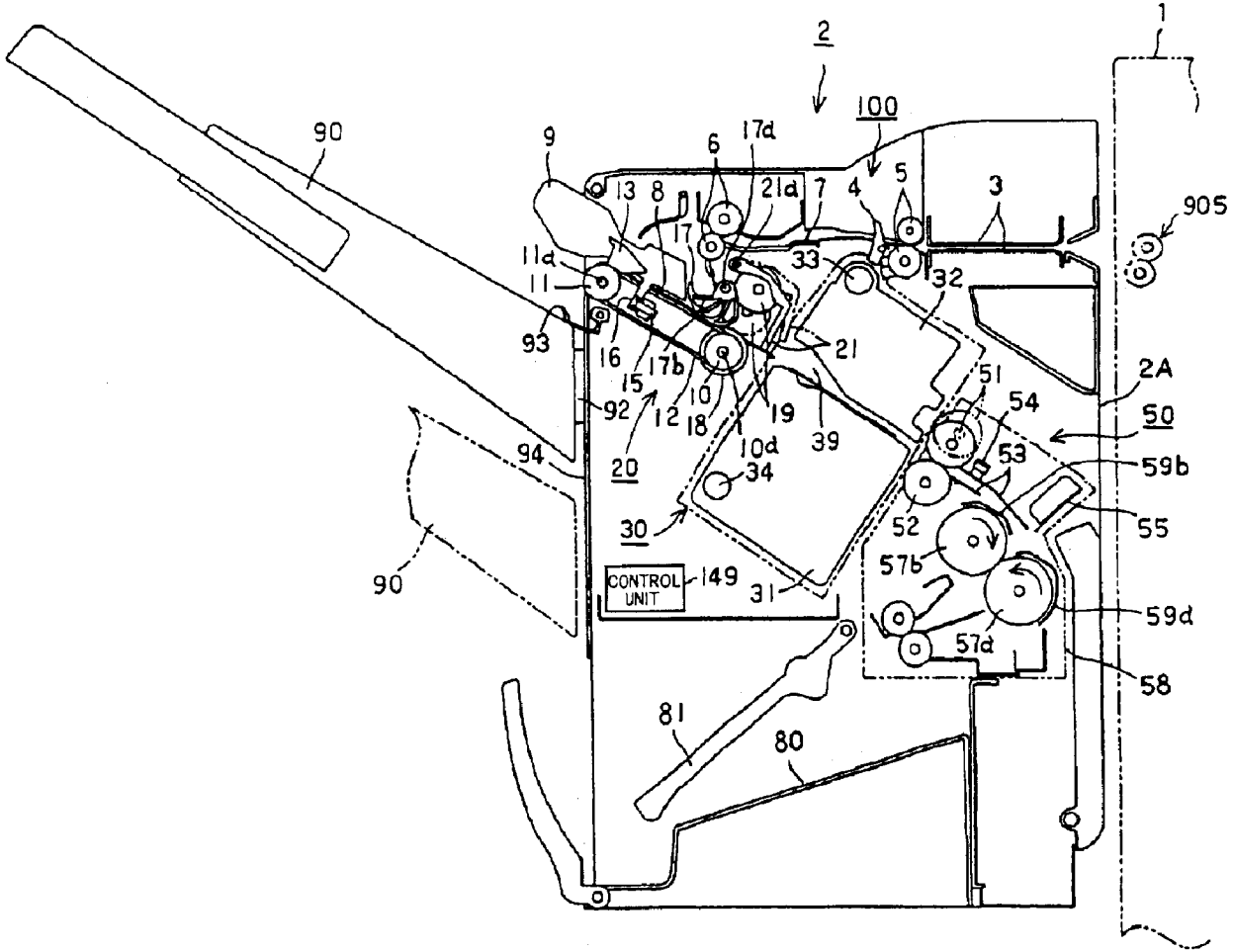
FIG. 6 is a front view of a sheet post-processing apparatus.

As shown in FIG. 6, in an apparatus frame 2A which is a casing, the sheet post-processing apparatus 2 has a conveying unit 100 which conveys a sheet discharged from the digital copying machine main body 1 to an opposite side of the discharging roller pair 905 in a generally horizontal direction, an arranging unit 20 which is disposed slantingly at a downstream side of the conveying unit 100 and which is capable of arranging end portions of sheets, a stapler unit 30 which is disposed slantingly at a downstream side of the arranging unit 30 and which carries out binding processing to a bundle of sheets, a folding unit 50 which is disposed slantingly at a downstream side of the stapler unit 30 and which carries out folding processing to the bundle of sheets such that a predetermined postion of the bundle of sheets as a folding position is folded, a stacking unit for stacking the bundle of sheets or a booklet (a bundle of sheets that folding processing is carries out), and a control unit 149 which controls each unit of the sheet post-processing apparatus 2.

Further, as shown FIG. 1, a stapler selection switch 935 for selecting binding processing to the bundle of sheets regardless of a binding position, an end bound sheets/bundle of sheets discharging tray selection switch 936 for selecting discharging of end bound sheets or the bundle of sheets to an ascending/descending tray 90 (See FIG. 6), and a center position binding+folded sheets discharging tray selection switch 937 for selecting discharging of the bundle of sheets that center position binding processing and folding processing are carries out to a bundle of folded sheets discharging stacker 80 are disposed at the sheet post-processing apparatus 2. These switches assist an operator to set complicated post-processing by performing check with eyes. However, an operator can set the complicated post-processing appropriately by operating the touch panel 248 or in accordance with setting information memorized in the hard disk 961.

As shown in FIG. 6, the conveying unit 100 has a conveying guide 3 which receives a sheet discharged from the digital copying machine main body 1 one by one and guides the sheet into an interior of the sheet post-processing apparatus 2, a carry-in guide 7 which is disposed at a downstream side of the conveying guide 3 and which further guides the sheet downstream, a conveying roller pair 5 which is disposed between the conveying guide 3 and the carry-in guide 7 and which nips and conveys the sheet, a sheet detecting sensor 4 which is disposed at a downstream side of the conveying roller pair 5 and which detects the sheet carried in by the carry-in guide 7 as well as a sheet jam inside the conveying unit 100, a discharging roller pair 6 which is disposed at an end downstream side of the carry-in guide 7 and which nips and discharges the sheet, and an unillustrated conveying motor for rotating the conveying roller pair 5 and the discharging roller pair 6.

The arranging unit 20 has a processing tray 8 for stacking the sheet discharged from the discharging roller pair 6. The processing tray 8 is disposed slantingly at an angle of about 30 degrees to an original document placement surface (platen glass 906) of the digital copying machine main body 1 with a sheet conveying direction downward in order to urge the sheet to convey downstream. Arranging plates 9 which move and arrange the sheet so as to guide both ends of the sheet to a center side are disposed on the processing tray 8. An unillustrated arranging motor is disposed at a lower position of the processing tray 8. A pinion 15 is fixed to a motor shaft of the arranging motor. The pinion 15 is geared with a rack 16. Slender and rectangular shaped fixing members are extended from a lower side of the arranging plates 9. A tip portion of each fixing member penetrates a slot formed in a width direction (near and inner sides of FIG. 6) of the processing tray 8 so as to be fixed to the rack 16. Accordingly, the arranging plates 9 are capable of moving toward the width direction of the processing tray 8 by rotation drive of the arranging motor according to a size of the sheet.

Pulleys 10, 11 are respectively fixed to pulley axes 10*a*, 11*a* at a central and lower position of the processing tray 8. An endless conveying belt 12 is entrained between pulleys 10, 11. A lower conveying roller 18 is fixed to the pulley axis 10*a*. A portion of an outer circumference of the lower conveying roller 18 is exposed from an upper surface of the processing tray 8 via a notched portion formed at the processing tray 8. Driving force is conveyed from an unillustrated reversibly rotatable stepping motor to the pulley axis 10*a*.

On the other hand, an upper conveying roller 19, which is capable of moving between an abutting position where the upper conveying roller 19 abuts against the lower conveying roller 18 as shown by a two-dot chain line and an alienating position where the upper conveying roller 19 alienates from the lower conveying roller 18 as shown by a full line, is disposed upward the upper conveying roller 18. The moving of the upper conveying roller 19 between the abutting position and the alienating position is carried out by operation of an unillustrated cam and the like, and rotation force of the upper conveying roller 19 is imparted from the above unillustrated stepping motor via gears.

A paddle 17 which rotates on an axis 17*a* by rotation force supplied from an unillustrated paddle motor and urges the sheet to a sheet conveying direction is disposed downward the carry-in guide 7 and upward the processing tray 8. The paddle 17 is made of an elastic member such as a rubber member and the like with a predetermined elasticity and which has a fin 17*b* formed integrally and radially from the axis 17*a* as its center. The paddle 17 is easy to deform when the sheet is discharged and stacked on the processing tray 8 and is capable of imparting appropriate urging force to the sheet being conveyed in the sheet conveying direction.

A thrusting pawl 13, which thrusts the bundle of sheets out toward a side of the ascending/descending tray 90 so as its end surface to abut on one end portion of the bundle of sheets which is piled on the processing tray 8, is fixed to the endless conveying belt 12. A home position (hereinafter, abbreviated as HP) is set for the thrusting pawl 13. The HP is set at a position where the end surface of the thrusting pawl 13 positions just under the pulley axis 10*a*. A detecting arm that engages with the trusting pawl 13 and an arm detecting sensor consisting of a transmission type integrated sensor are disposed at a lower side of the endless conveying belt 12 in order to detect the HP of the thrusting pawl 13.

A stopper 21 for regulating and arranging one end of the sheet which is urged so as to drop on the slantingly disposed processing tray 8 in the sheet conveying direction by its own weight and which is further urged by rotation of the paddle 17 is disposed at an upper side of the processing tray 8 and at a side of the stapler unit 30. The stopper 21 has a cross sectional shape of approximately letter J and has a leg portion and an arm portion. One side of the arm portion of the stopper 21 is connected to a plunger of an unillustrated solenoid, and another side of the arm portion is pulled by a spring with predetermined tensile force. The stopper 21 is capable of pivoting around a supporting axis as a fulcrum positioning at approximately a center of the arm position and is capable of moving between a regulating position where a bottom face of the leg portion (tip of the leg portion) abuts against the upper face of the processing tray 8 as shown by a full line and an evacuated position where the bottom face of the leg portion is evacuated from the upper face of the processing tray 8 as shown by a two-dot chain line according to an on/off state of the unillustrated solenoid.

The thrusting pawl 13 is capable of moving toward a side of ascending/descending tray 90 at a normal time (i.e., The upper conveying roller 19 is disposed at the alienating position and the stopper 21 is disposed at the evacuated position). Therefore, the thrusting pawl 13 is capable of conveying the bundle of sheets whose one end portion is arranged by the stopper 21 which is disposed at the regulating position, or of conveying the bundle of sheets whose one end portion is arranged to the side of the staple unit 30 with nipping by both the lower conveying roller 18 and the upper conveying roller 19 which positions at the abutting position.

The stapler unit 30 is disposed at a downstream side of the arranging unit 20, and has a head assembly 31 which is disposed at an upper side and which has a cartridge for staple needles and punches a staple needle out and an anvil assembly 32 which is disposed at a lower side and which receives and bends the tip portions of the staple needle punched out from the head assembly 31 so as the assemblies 31, 32 to nip a conveying path 39 for conveying the bundle of sheets. The stapler unit 30 has a function for carrying out binding processing to an end portion or a center portion of the bundle of sheets according to a conveying distance of the bundle of sheets which is nipped and conveyed by the lower conveying roller 18 and the upper conveying roller 19. The stapler unit 30 carries out the binding processing with the staple needles to a plurality of portions of the bundle of sheets via cylindrical guiding rods 33, 34 for supporting and guiding the head assembly 31 and the anvil assembly 32 in a direction intersecting to the sheet conveying direction. Incidentally, the stapler unit 30 is constituted as a unit as shown by a two-dot chain line and is configured to allow drawing out from the sheet post-processing apparatus 2 to a near side of FIG. 6 such that the staple needles can be supplied.

The folding unit 50 is constituted as a unit as shown by a two-dot chain line and is disposed at a downstream side of the stapler unit 30. The folding unit 50 is configured to allow drawing out from the sheet post-processing apparatus 2 in the same manner as the stapler unit 30.

An upper bundle-conveying roller 51 and a lower bundle-conveying roller 52 for nipping and conveying the bundle of sheets downstream are disposed at an entrance of the folding unit 50. A bundle conveying guide 53 for guiding to a further downstream side the bundle of sheets which is conveyed by the upper bundle-conveying roller 51 and the lower bundle-conveying roller 52 is disposed at a downstream side of the roller pair. An end detecting sensor 54 which is a transmission type integrated sensor and which detects a leading end of the bundle of sheets is disposed at a bundle conveying path formed by the bundle conveying guide 53. The control unit 149 controls to drive the upper bundle-conveying roller 51 to contact with the lower bundle-conveying roller 52 according to a leading end detecting signal from the end detecting sensor 54 and controls setting of a folding position in a conveying direction of the bundle of sheets.

The upper bundle-conveying roller 51 is constituted so as to be movable between a full line position where it contacts with the lower bundle-conveying roller 52 with pressure and a position where it alienates from the lower bundle-conveying roller 52 (See two-dot chain line in FIG. 6). The upper bundle-conveying roller 51 and the lower bundle-conveying roller 52 take an alienating state until the leading end of the bundle of sheets is detected by the end detecting sensor 54, and when the leading end of the bundle of sheets is detected, they take a contacting state. The upper conveying roller 19 shifts from the abutting position to the alienating position almost synchronizing with the contacting state. Accordingly, the conveying of the bundle of sheets downstream is handed over to the conveying with pressure by the upper bundle-conveying roller 51 and the lower bundle-conveying roller 52.

A roller pair consisting of folding rollers 57*a*, 57*b* which are urged with each other so as to contact with pressure in a direction intersecting to the conveying direction of the bundle of sheets and which are driven to rotate respectively is disposed at a lower side of the conveying guide 53 in order to fold the bundle of sheets. The folding rollers 57*a*, 57*b* have a predetermined roller diameter (e.g., phi: 40 mm) which needs to rotate at least one revolution at a time of folding the bundle of sheets.

A pushing plate 55 whose head edge advances to a vicinity of a contacting position of the folding rollers 57*a*, 57*b* so as to push the bundle of sheets to the contacting position of the folding rollers 57*a*, 57*b* is disposed at a downstream side of the conveying guide 53 and in a direction intersecting to the conveying direction of the bundle of sheets. The pushing plate 55 is made of stainless steel and a thickness of the head edge is approximately 0.25 mm.

Backup guides 59*a*, 59*b* which are formed in an arc shaped configuration and which back up guiding of the bundle of sheets by the bundle conveying guide 53 are disposed at an upper side and periphery of the folding rollers 57*a*, 57*b*. The backup guides 59*a*, 59*b* are constituted to link with up-and-down motion of the pushing plate 55 in the direction intersecting to the conveying direction of the bundle of sheets and to open a peripheral face of the folding rollers 57*a*, 57*b* to the bundle of sheets when the leading edge of the pushing plate 55 advances to the vicinity of the contacting (nipping) position of the folding rollers 57*a*, 57*b*.

A folded bundle discharging stacker 80, which has an inclined face opposing to inclined dispositions of the arranging unit 20, the stapler unit 30 and the folding unit 50 and which stacks the bundle of sheets that the folding processing has been carried out by the folding unit 50, is disposed at a downstream side of the folding unit 50 and at a bottom position of the sheet post-processing apparatus 2. A folded bundle holding foot 81 of which one end is rotatably fixed and which holds the discharged bundle of sheets with urged force of a spring or the like coupled with dropping force of the inclined face of the folded bundle discharging stacker 80, is disposed at an upper side of the folded bundle discharging stacker 80.

Further, the ascending/descending tray 90 which is capable of ascending and descending in a vertical direction to the apparatus frame 2A is disposed at a side face of the apparatus frame 2A which is a side opposing to the digital copying machine main body 1. The ascending/descending tray 90 is supported by an ascending/descending support member 92. The ascending/descending support member 92 ascends or descends by an unillustrated ascending/ descending tray motor via a belt. Incidentally, the ascending/descending tray 90 is capable of ascending and descending between an upper limit shown as a full line position and a lower limit shown as a two-dot chain line position in FIG. 6.

The ascending/descending tray 90 has an auxiliary tray. The auxiliary tray is pulled out from the ascending/descending tray 90 at a time of stacking large sized sheets and the like. A sheet face sensor 93 for detecting an uppermost face of sheets stacked on the ascending/descending tray 90 is disposed at a lower side of the pulley 11 of the arranging unit 20. Further, a rear end guide 94 for guiding a rear end of the sheet to be stacked when the ascending/descending tray 90 ascends or descends is disposed at a side face of the apparatus frame 2A facing the ascending/descending tray 90.

The control unit 149 is constituted to include a CPU, a ROM that memorizes in advance programs to be carried out by the CPU and program data, a RAM that functions as a working area for the CPU and memorizes control data and the like received from the control unit 950 of the digital copying machine main body 1, an interface, and the like. Further, as shown in FIG. 5, the control unit 149 is connected via an external bus to the stapler selection switch 935, the end bound sheets/bundle of sheets discharging tray selection switch 936, and the center position binding+folded sheets discharging tray selection switch 937.

The sheet post-processing apparatus 2 is capable of carrying out various post-processing to sheets such as conveying a plurality of sheets discharged from the digital copying machine main body 1 to the ascending/descending tray 90 after the edge portion of the sheets is arranged by the arranging unit 20, conveying the bundle of sheets to the ascending/descending tray 90 after binding processing is carried out by the stapler unit 30, discharging a booklet to the folded bundle discharging stacker 80 after binding processing is carried out to the center of the sheets by the stapler unit 30 and folding processing is further carried out to produce the booklet by the folding unit 50, discharging the booklet to the folded bundle discharging stacker 80 after the folding processing is carried out to produce the booklet by the folding unit 50 without binding processing according to the stapler unit 30, or the like.

<Operation>

Next, registration/renewal of the setting information according to the digital copying machine 1A of this embodiment and operation of the digital copying machine 1A will be explained in this order.

1. Registration/Renewal of Setting Information

As shown in Table 1 below, setting information including operator information inherent to an operator and system setting information that an operator can set arbitrarily for each operator is memorized (stored) in advance as a look-up table in the hard disk 961 of the digital copying machine main body 1.

TABLE 1

| Setting Information | Contents of Information | |
|---|---|---|
| Operator Information | ID, Name, Age, Height, With or Without Handicap, Content of Handicap, Nationality | |
| System Setting Information | Main Body | Equal Magnification, Lengthwise A4 |
| | Touch Panel | Enlarged Character Indication |
| | Post-Processing | Upper Left Binding |

The operator information includes an ID, a name, an age, a (body) height, with or without handicap, content of the handicap, and nationality in order to specify (identify) an operator. An unique identification number such as, for example, a staff number or the like may be used for the ID. Further, color handicap (what is called colorblindness), visual handicap (what is called blindness), illiterate handicap (what is called illiteracy), physical handicap (e.g., a person using a wheelchair), poor sight, trembling of fingers, and the like are listed as the content of the handicap. The content of the handicap and the nationality are coded and stored in the hard disk 961. The operator information is also stored in the hard disk 961 by receiving from the PC 210 that is capable of linking with a portion of personnel information via an unillustrated network.

Figure 7A:
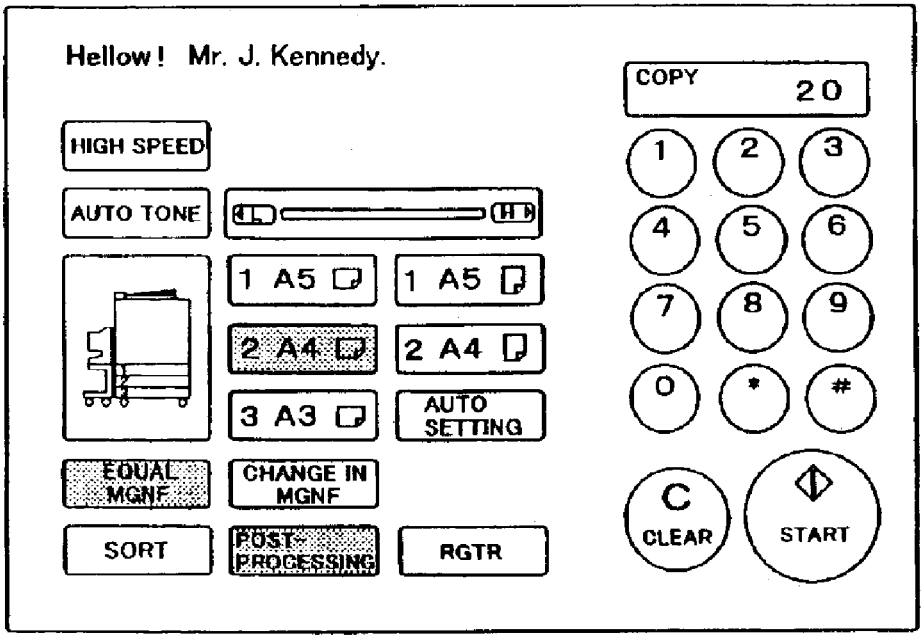
FIG. 7A showing a displaying state of the touch panel at an ordinary or high tone time, FIG. 7B showing a displaying state of the touch panel when enlarged letters are displayed.
Figure 7B:
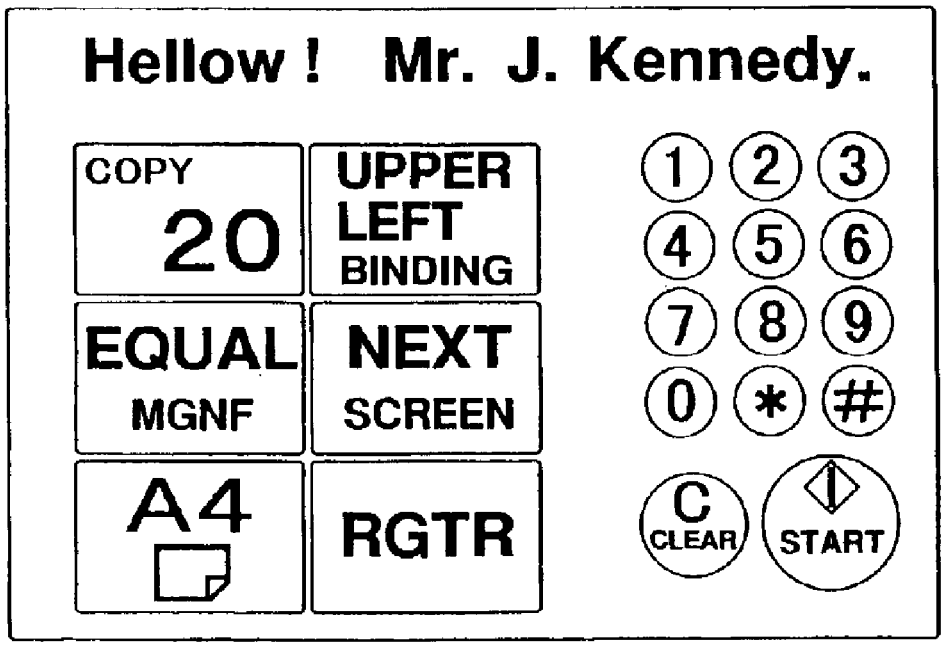
FIG. 7 is a plan view illustratively showing an image displayed on the touch panel of the digital copying machine main body.

On the other hand, the system setting information is information that setting of the digital copying machine main body 1, the touch panel 248, and the sheet post-processing apparatus 2 is customized by each operator. The system setting information shown in Table 1 is one example set by a certain operator, which shows that the digital copying machine main body 1 is set to equal magnification (MGNF) and lengthwise A4 size, the touch panel 248 is set to enlarged character indication (See FIG. 7B), and the sheet post-processing apparatus 2 is set to upper left binding which binding processing by a staple needle is carried but at an upper left portion of the bundle of sheets. As shown in FIGS. 7A, 7B, an operator can perform registration/renewal of the system setting information by selecting "REGISTRATION (RGST)" first, and then inputting his/her selection by finger touch according to a selection menu of a separate screen (view) which is displayed for each digital copying machine main body 1, touch panel 248, and sheet post-processing apparatus 2. Incidentally, the languages that the touch panel 248 of this embodiment can display are English, French, German, Spanish, Chinese, and Japanese. An operator can choose one language that he/she can understand among these languages at "CONTENT OF INFORMATION" of "TOUCH PANEL" in the system setting information, if there is no language corresponding to his/her nationality in operator information. When the registration/renewal data of the system setting information is transmitted from the touch panel control unit 250, the CPU of the control unit 950 (hereinafter, abbreviated as the CPU) controls the hard disk 961 to memorize the information.

2. Operation

The CPU waits until it receives an ID from one of the card reader control unit 261, the fingerprint sensor control unit 262, and the touch panel control unit 250. That is, if an operator gets the IC card in which an ID is memorized close to the card reader 181, the card reader 181 reads the ID memorized in the IC card and the card reader control unit 261 transmits the ID to the CPU. If an operator touches his/her finger to the fingerprint sensor 182, the fingerprint sensor control unit 262 extracts fingerprint characteristics and then transmits the ID corresponding to the operator coincided with the fingerprint characteristics to the CPU. If an operator inputs his/her ID by pushing (touching by his/her finger) certain buttons of the touch panel 248 (e.g., when the ID is "123", if he/she pushes the buttons of "*, 1, 2, 3, #" where "*" and "#" are added for identification of inputting of his/her ID as well as a start button), the touch panel control unit 250 transmits the inputted ID to the CPU. When the CPU receives the ID, the CPU retrieves the same ID stored in the hard disk 961 in order to acquire the setting information corresponding to the same ID.

Next, the CPU controls the touch panel control unit 250 to set the screen displayed by the touch panel 248 in accordance with the acquired setting information. Namely, the CPU determines about whether the age is a predetermined number (e.g., 60 years old) or more. If an affirmative determination is made, the CPU transmits a tone or gradation default value (e.g., 1) to the touch panel control unit 250 in order to increase tone (contrast) of an image to be displayed on the touch panel 248. On the other hand, when a negative determination is made, the CPU transmits a normal tone default value (e.g., 0) to the touch panel control unit 250 in order to retain normal (standard) setting. Thus, the touch panel control unit 250 changes tone or gradation of an image to be displayed on the touch panel 248.

Then, the CPU transmits a default value of the language to the touch panel control unit 250 so as the touch panel 248 to display an image by the language according to the nationality or the selected language. Further, the CPU transmits name data corresponding to an ID to the touch panel control unit 250 so as the touch panel 248 to display the name of the operator (See FIGS. 7A, 7B).

Further, the CPU determines about whether or not an operator is the handicapped according to with or without handicap. In case that an affirmative determination is made and when the content of the handicap is identified as color handicap, the CPU transmits a default value thereof to the touch panel control unit 250. Colors of an image to be displayed on the touch panel 248 are changed to a color (e.g., monochrome) so that the color handicapped can recognize the image (See FIG. 7A). When the content of handicap is poor sight or trembling of fingers, the CPU transmits a default value thereof to the touch panel control unit 250 so that the touch panel 248 is displayed by enlarged character indication (See FIG. 7B). Incidentally, even in a case of a normal person with good sight or without trembling of fingers, if the system setting information is set to the enlarged character indication as shown in Table 1, the default value is transmitted to the touch panel control unit 250 so as the touch panel 248 to display by the enlarged character indication in the same manner.

Then, the CPU changes the height and angle of the information-detecting unit 301. That is, when the CPU determines that an operator is a person using a wheelchair according to the content of the handicap in case of the handicapped, the CPU controls the motor driver 263 to drive the unit ascending/descending motor 183 so as the information-detecting unit 301 to descend to the lowermost position (See a dashed line position in FIG. 2). Further, the CPU outputs a high level signal to the solenoid control unit 269 so that the solenoid 196 becomes an on state. This brings the guide pin 191 shown in FIG. 4B abuts on the upper portion of the slot 189 and the information-detecting unit 301 inclines at about 30 degrees. Accordingly, it becomes easy for an operator using a wheelchair to see the touch panel 248. On the other hand, in case of without handicap, the CPU refers to a look-up table which defines a relationship between body height of an operator and height of the information-detecting unit 301 and which is memorized in advance in the ROM and has been developed in the RAM in an initial setting processing so as to calculate the height of the information-detecting unit 301 by acquiring the height of the operator which is memorized in the hard disk 961. Such a look-up table may have height position information of the information-detecting unit 301 corresponding, for example, to every 5 cm that the height of an operator differs, and the CPU may obtain the height position of the information-detecting unit 301 corresponding to height of every operator by proportional distribution calculation. Then, the CPU calculates the number of pulses corresponding to the height position calculated by the proportional distribution and transmits information of the number of pulses to the motor driver 263 so that the motor driver 263 drives the unit ascending/descending motor 183.

Next, the CPU controls the touch panel 248 via the touch panel control unit 250 to display the acquired contents of information (equal magnification, lengthwise A4) of the digital copying machine main body 1 and of information (upper left binding) of the sheet post-processing apparatus 2, then the CPU waits until an operator inputs the number of copies and pushes the start button after setting may be changed (See FIGS. 7A, 7B).

On the other hand, when the content of the handicap is the visual handicapped or illiteracy in case of the handicapped, since an operator has difficulties in inputting from the touch panel 248, the CPU controls the voice output control unit 264 and the voice input control unit 265 to operate so that an operator is allowed to change the number of copies or setting according to a voice dialog. Namely, the CPU controls the speaker 184 through the voice output control unit 264 to guide the present setting states to an operator. For example, voice guidance (inquiry) such as "Setting is equal magnification. Is this all right, sir?" is carried out. Then, the CPU acquires a voice answer of "Yes" or "No" from an operator from the voice recognition circuit of the voice input control unit 265 via the input microphone 185. When the voice recognition circuit is incapable of recognizing either of "Yes" or "No", the CPU controls the speaker 184 to carry out voice guidance such as "Your voice was not recognized, sir. May I ask you again?"+"Setting is equal magnification. Is this all right, sir?" and acquires a voice answer from an operator. When the answer is "No", the CPU acquires setting that an operator wishes one by one by carrying out voice guidance such as "Do you change magnification, sir?", "What percentage do you set, sir?", and the like. An operator makes a simple answer such as "71" to the voice guidance "What percentage do you set, sir?" The voice input control unit 265 makes an operator to confirm his/her answer by repeating the answer as a rule in order to recognize correct operator's instructions. Incidentally, an operator is allowed to register or renew the system setting information according to voice in the same manner as the touch panel 248.

After the original document D is set at the ADF 940, when the start button of the touch panel 248 is pressed by an operator, or when an answer "Start" from an operator is confirmed by the voice input control unit 265 via the input microphone 185, the CPU fetches all setting information regarding the digital copying machine 1A which is transmitted from the touch panel control unit 250 or the voice input control unit 265. Hereinafter, an example that all setting information of the digital copying machine 1A was set as the system setting information shown in Table 1 and FIG. 7B will be explained for simplification. Incidentally, all or part of selection or setting input from the touch panel 248 may be replace by input from the PC 210 or from the manual switches such as the stapler selection switch 935 as shown in FIG. 1 by black spots.

The CPU fetches image data read by the image inputting section 200 via the A/D converter 960 and stores the data into the hard disk 961 one after another. Incidentally, when images are read by using the ADF 940, the CPU can judge whether reading of the original document D is completed according to a signal from an unillustrated empty sensor disposed at the ADF 940. When images are read one by one without using the ADF 940, the CPU urges an operator to push an image reading completion button such as "#" or the like, and when the button is pressed, the CPU determines that reading is completed.

Then, after transmitting setting information relating to the sheet post-processing apparatus 2 to the control unit 149 of the sheet post-processing unit 2, the CPU controls the image forming section 902 to form an image on a sheet in accordance with image data stored in the hard disk 961. That is, the sheet feeding control unit 180 drives a roller pair to rotate so as to feed an A4 sheet from the cassette 911. The skew of the sheet is revised by the roller pair in the sheet feeding section 909, and the sheet is conveyed to the image forming section 902 after the timing of feeding the sheet is adjusted. The CPU controls the laser unit 922 to irradiate image data for one sheet line by line to the photoconductor drum 914. The photoconductor drum 914 is charged in advance by the first charging unit 919, and a static latent image is formed on the photoconductor drum 914 by irradiated light. The developing unit 915 develops the static latent image so that a toner image is formed on the photoconductor drum 914.

The toner image on the photoconductor drum 914 is transferred onto the fed sheet by the transfer-charging unit 916 in the image forming section 902. The sheet on which the toner image is transferred is separated from the photoconductor drum 914 by the separation-charging unit 917 with charge antipolar to the transfer-charging unit 916. Further, the separated sheet is conveyed to the fixing unit 904 by the endless conveying belt 920. The transferred image is fixed permanently by the fixing unit 904 so that an image is formed (recorded) on the sheet. When double face printing is carried out, an image is formed on another face of the sheet via the duplex 921. Thereafter the sheet on which an image is formed is discharged from the digital copying machine main body 1 to the sheet post-processing apparatus 2 one by one by the discharging roller pair 905.

On the other hand, when receiving the setting information relating to the sheet post-processing apparatus 2 from the CPU of the control unit 950 in the digital copying machine main body 1, the control unit 149 of the sheet post-processing unit 2 drives an unillustrated stapler slide motor to move the head assembly 31 as well as the anvil assembly 32 to their initial positions and turns on an unillustrated solenoid to position the stopper 21 at the regulating position. Next, the control unit 149 operates the unillustrated conveying motor so as to rotate the conveying roller pair 5 and the discharging roller pair 6 so as to discharge the sheet which is discharged from the digital copying machine main body 1 to the processing tray 8. The control unit 149 also actuates both the arranging motor for moving the arranging plates 9 and the paddle motor for rotating the paddle 17. The both ends in a width direction of the sheet is arranged by the arranging plates 9, and then the sheet is urged to move on the upper face of the processing tray 8 until it reaches a position where the leading end of the sheet abuts on a side face of the leg portion of the stopper 21 so as to stop at an appropriate position. By repeating this manner a predetermined number of sheets, a bundle of sheets is laid in a state that the stopper 21 regulates an edge portion of the bundle of sheets.

Next, after moving the upper conveying roller 19 to the side of the lower conveying roller 18 so as to nip the bundle of sheets therebetween in the state that the stopper 21 regulates the bundle of sheets, the CPU turns off the unillustrated solenoid so as to position the stopper 21 at the evacuated position. Then, the CPU actuates the unillustrated stepping motor by a predetermined number of steps. According to this actuation, the upper conveying roller 19 and the lower conveying roller 18 conveys the bundle of sheets to the side of the stapler unit 30 with nipping the bundle of sheets until a binding position of the bundle of sheets reaches a head position of the head assembly 31 whose position is at the initial position. Then, binding processing to an upper left portion of the bundle of sheets is carried out by the head assembly 31 and the anvil assembly 32.

The CPU controls to convey the bundle of sheets to the ascending/descending tray 90 after the binding processing is completed. Namely, the CPU actuates the lower conveying roller 18, the upper conveying roller 19, and the endless conveying belt 12 to the side of the ascending/descending tray 90 so as to hand conveying of the bundle of sheets after binding processing thereof over to the thrusting pawl 13 from the nip conveying carried out by the lower conveying roller 18 and the upper conveying roller 19. The thrusting pawl 13 thrusts the bundle of sheets toward the ascending/descending tray 90 (a state shown in FIG. 6), thereby the bundle of sheets is stacked on the ascending/descending tray 90. After the bundle of sheets is stacked on the ascending/descending tray 90, the CPU rotates the ascending/descending tray motor so that the ascending/descending tray 90 descends a predetermined amount (distance), and then reverses the ascending/descending tray motor so that the ascending/descending tray 90 ascends up to a position where the sheet face sensor 93 detects the uppermost face of the sheets. The ascending/descending tray 90 stands by at this position until the next bundle of sheets is stacked.

<Effects and the Like>

Next, effects and the like of the digital copying machine !A of this embodiment will be explained below.

The control unit 950 (CPU) of the digital copying machine 1A changes an image which is displayed on the touch panel 248 corresponding to each operator in accordance with the operator information stored in the hard disk 961 with the ID which is specified by the IC card, the fingerprint of an operator, or input from the touch panel 248. That is, if an operator is the aged, the contrast of the image is raised by changing the tone (gradation); if an operator is the colorblind, an image to be displayed is made recognizable by changing the color; and if an operator is the poor sighted or a person with trembling fingers, an image is displayed by the enlarged character indication. Besides, the language is also changed depending on an operator. Accordingly, an digital copying machine that is easy to use according to characteristics of an operator can be realized. Therefore, an operator can perform clerical work efficiently by using the digital copying machine 1A. Incidentally, the reason why the enlarged character indication is carried out for the person with trembling fingers is to avoid pressing (touching) wrong buttons near to the button that an operator wishes to press by making sizes of buttons displayed on the touch panel 248 large as explicitly shown in FIG. 7B.

Further, the digital copying machine 1A can adjust (change) the height and angle of the information-detecting unit 301 (touch panel 248) due to the unit ascending/descending motor 183 and the solenoid 196. Accordingly, the digital copying machine 1A makes the handicapped using the wheelchair easy to see the image displayed on the touch panel 248. Besides, the digital copying machine 1A adjusts the height of the information-detecting unit 301 corresponding to the body height of each operator even if he/she is a normal person without physical handicap. Accordingly, an operator can perform inputting operation with his/her comfortable posture. Moreover, the digital copying machine 1A carries out voice guidance and allows voice input by actuating the voice output control unit 264 and the voice input control unit 265. Therefore, a digital copying machine that is also easy to use for the blind or the illiterate can be realized.

Furthermore, the digital copying machine 1A can omit inputting of the same contents which is repeatedly performed by an operator since the digital copying machine 1A allows an operator to register (memorize in the hard disk 961 in advance) the system setting information of the digital copying machine main body 1 and the sheet post-processing apparatus 2 arbitrarily such that each operator can customize the digital copying machine 1A. Accordingly, an operator can save his/her time for setting the digital copying machine 1A and avoids setting errors. Therefore, the digital copying machine 1A further enhances efficiency in clerical work performed by an operator.

Incidentally, the digital copying machine was shown as an image forming apparatus in this embodiment. However, the present invention is not limited to the same, and may be applied generally to an apparatus that forms an image such as a printer, a facsimile machine, or the like. Further, the sheet post-processing apparatus 2 as a peripheral apparatus was shown in this embodiment. However, the present invention may be applied to a digital copying machine having a sorter or a large capacity sheet-feeding unit like a LCT as a peripheral apparatus.

Further, in this embodiment, the non-contact type IC card and card reader 181 were shown. However, a card-shaped recording medium having a magnetic stripe and a contact type card reader that reads the magnetic stripe may be used. Such a structure reduces a running cost since a low cost magnetic recording medium can be used.

Furthermore, the card reader 181, the fingerprint sensor 182, and the touch panel 248 were shown as an identifying unit in this embodiment. However, a retina-detecting unit for detecting retina features inherent to an operator or an image analysis unit for analyzing face features of an operator and identifying an operator may be used as an identifying unit. For example, when the image analysis unit is used for the identifying unit, as shown in above-described U.S. Pat. No. 6,038,333 (of which disclosed technique is incorporated in this specification), the digital copying machine 1A is further provided with a digital camera, and such a structure as one example maybe adopted that the image analysis unit extracts face characteristic data of an operator by analyzing image data obtained from the digital camera and the CPU specifies an operator by comparing the extracted face characteristic data with each of face characteristic data of a plurality of face images stored in the hard disk 961. Further, in this embodiment, an example that an operator is allowed to access the digital copying machine 1A according to the ID detected by the card reader 181, the fingerprint sensor 182, or the touch panel 248 was shown. However, the CPU may allow an operator to operate the digital copying machine 1A when the control unit 950 receives the same ID from plural units among these identifying units. This enhances security of the digital copying machine 1A. Moreover, privacy of an operator can be protected by prohibiting access to the operator information stored in the hard disk 961 via the touch panel 248 or the input microphone 185.

Further, an example was shown in this embodiment that the ID was memorized in the IC card and the setting information is stored in the hard disk 961. However, the present invention is not limited to the same. For example, such a constitution may be taken that the hard disk 961 does not store setting information, and that the card reader 181 reads the setting information memorized in the IC card in which all information including or excluding the ID as shown in Table 1 is recorded. This omits labor and time for transmitting the setting information from the PC 210 to the hard disk 961. Furthermore, such a constitution may be adopted that the IC card memorizes the setting information only and an operator inputs the ID by the fingerprint sensor 182 or the touch panel 248. In such a constitution, the touch panel 248 and the like can be set in the most suitable state for clerical work to each operator according to the ID. Moreover, common system setting information maybe utilized by a common IC card which is usable to a group or the like to which an operator belongs. This also contributes to reducing inputting time or inputting errors. In this case, a plurality of IC cards that the setting information differs with each other is prepared in advance, and an operator may select one of IC cards depending upon clerical work.

What is claimed is:

1. An image forming system that has an image forming apparatus which forms an image on a sheet and at least one peripheral apparatus which is connected to the image forming apparatus, comprising:

an identifying unit for identifying an operator;

a memory for memorizing setting information of the image forming system corresponding to an operator in advance, the setting information including an operator-specific setting which allows the image forming system to be adjusted to accommodate an ability and/or limitation of the operator; and a control unit for controlling the image forming system based upon the setting information memorized in the memory according to the operator identified by the identifying unit.

2. An image forming system according to claim 1, wherein the image forming system further comprising a voice guiding unit for guiding an operating state or operation procedure of the image forming system by voice, and the control unit operates the voice guiding unit according to the operator identified by the identifying unit.

3. An image forming system according to claim 2, wherein the image forming system further comprising a voice inputting unit for inputting the setting information of the image forming system by voice of an operator, and the control unit operates the voice guiding unit and the voice inputting unit according to the operator identified by the identifying unit.

4. An image forming system according to claim 1, wherein the identifying unit identifies an operator by an external recording medium.

5. An image forming system according to claim 4, wherein the external recording medium is a non-contact type recording medium which allows the identifying unit to identify an operator with non-contact.

6. An image forming system according to claim 1, wherein the identifying unit identifies an operator according to key input performed by the operator.

7. An image forming system according to claim 1, wherein the identifying unit identifies an operator by a fingerprint of the operator.

8. An image forming system according to claim 1, wherein the identifying unit identifies an operator by features of a face of the operator.

9. An image forming system that has an image forming apparatus which forms an image on a sheet and at least one peripheral apparatus which is connected to the image forming apparatus, comprising:

a display for displaying an operating state and/or operation procedure of the image forming system;

an identifying unit for identifying an operator;

a memory for memorizing setting information of the image forming system corresponding to an operator in advance, the setting information including an operator-specific setting which allows the image forming system to be adjusted to accommodate an ability and/or limitation of the operator; and a control unit for controlling the image forming system based upon the setting information memorized in the memory according to the operator identified by the identifying unit.

10. An image forming system according to claim 9, wherein the control unit controls the display such that at least one of a color, a tone, and a size of an image that is displayed on the display is changed according to the operator identified by the identifying unit.

11. An image forming system according to claim 9, wherein the control unit controls the display such that a language that is displayed on the display is changed according to the operator identified by the identifying unit.

12. An image forming system according to claim 9, wherein the image forming system further comprising an adjusting unit for adjusting a height and/or an angle of the display, and the control unit controls the adjusting unit such that the height and/or the angle of the display is adjusted according to the operator identified by the identifying unit.

13. An image forming system according to claim 9, wherein the image forming system further comprising a voice guiding unit for guiding an operating state or operation procedure of the image forming system by voice, and the control unit operates the voice guiding unit according to the operator identified by the identifying unit.

14. An image forming system according to claim 13, wherein the image forming system further comprising a voice inputting unit for inputting the setting information of the image forming system by voice of an operator, and the control unit operates the voice guiding unit and the voice inputting unit according to the operator identified by the identifying unit.

15. An image forming system according to claim 9, wherein the identifying unit identifies an operator by an external recording medium.

16. An image forming system according to claim 15, wherein the external recording medium is a non-contact type recording medium which allows the identifying unit to identify an operator with non-contact.

17. An image forming system according to claim 9, wherein the identifying unit identifies an operator according to key input performed by the operator.

18. An image forming system according to claim 9, wherein the identifying unit identifies an operator by a fingerprint of the operator.

19. An image forming apparatus which forms an image on a sheet, comprising:

an identifying unit for identifying an operator;

a memory for memorizing setting information of the image forming apparatus corresponding to an operator in advance, the setting information including an operator-specific setting which allows the image forming system to be adjusted to accommodate an ability and/or limitation of the operator; and a control unit for controlling the image forming apparatus based upon the setting information memorized in the memory according to the operator identified by the identifying unit.

20. An image forming apparatus according to claim 19, wherein the image forming apparatus further comprising a display for displaying an operating state or operation procedure of the image forming apparatus.

21. An image forming system that has an image forming apparatus which forms an image on a sheet and at least one peripheral apparatus which is connected to the image forming apparatus, comprising:

an identifying unit for identifying an operator;

a memory for memorizing setting information of the image forming system corresponding to an operator in advance; and a control unit for controlling the image forming system based upon the setting information memorized in the memory according to the operator identified by the identifying unit, wherein the control unit controls the display such that at least one of a color, a tone, and a size of an image that is displayed on the display is changed according to the operator identified by the identifying unit.

22. An image forming system that has an image forming apparatus which forms an image on a sheet and at least one peripheral apparatus which is connected to the image forming apparatus, comprising:

an identifying unit for identifying an operator;

a memory for memorizing setting information of the image forming system corresponding to an operator in advance; and a control unit for controlling the image forming system based upon the setting information memorized in the memory according to the operator identified by the identifying unit, wherein the image forming system further comprising a voice guiding unit for guiding an operating state or operation procedure of the image forming system by voice, and the control unit operates the voice guiding unit according to the operator identified by the identifying unit.

* * * * *